US010792628B2

(12) United States Patent
Stevens

(10) Patent No.: US 10,792,628 B2
(45) Date of Patent: Oct. 6, 2020

(54) ENHANCED MICRO BUBBLE DEVICE, SYSTEM AND METHODS RELATED THERETO

(71) Applicant: Oxygen Systems, LLC, Aurora, CO (US)

(72) Inventor: Ron Stevens, Aurora, CO (US)

(73) Assignee: Hydro Massage Products LLC, Aurora, CO (US)

( * ) Notice: Subject to any disclaimer, the term of this patent is extended or adjusted under 35 U.S.C. 154(b) by 0 days.

(21) Appl. No.: 16/597,724

(22) Filed: Oct. 9, 2019

(65) Prior Publication Data

US 2020/0038819 A1 Feb. 6, 2020

Related U.S. Application Data

(63) Continuation-in-part of application No. 16/565,314, filed on Sep. 9, 2019, which is a continuation of application No. 15/146,689, filed on May 4, 2016, now abandoned.

(60) Provisional application No. 62/156,642, filed on May 4, 2015, provisional application No. 62/743,197, filed on Oct. 9, 2018.

(51) Int. Cl.

| | |
|---|---|
| ***B01F 5/04*** | (2006.01) |
| ***B05B 7/04*** | (2006.01) |
| ***B01F 5/10*** | (2006.01) |
| ***B01F 3/04*** | (2006.01) |
| *B05B 7/24* | (2006.01) |

(52) U.S. Cl.

CPC ..... *B01F 5/0413* (2013.01); *B01F 3/04503* (2013.01); *B01F 5/106* (2013.01); *B05B 7/0425* (2013.01); *B01F 2003/04858* (2013.01); *B01F 2003/04872* (2013.01); *B05B 7/24* (2013.01)

(58) Field of Classification Search

CPC ..... B01F 2003/04858; B01F 3/0446; B05B 7/24; A61H 33/02

See application file for complete search history.

(56) References Cited

U.S. PATENT DOCUMENTS

| | | | | |
|---|---|---|---|---|
| 5,314,644 | A * | 5/1994 | Michelsen | B01F 7/005 209/170 |
| 5,514,267 | A * | 5/1996 | Machiya | B01F 3/04099 210/170.06 |
| 6,054,046 | A * | 4/2000 | Nelson | B01D 19/001 210/194 |
| 7,913,984 | B2 * | 3/2011 | Noguchi | B01F 3/0446 261/29 |
| 8,201,811 | B2 * | 6/2012 | Cunningham | A01K 13/001 261/121.1 |
| 2015/0314248 | A1 * | 11/2015 | Castellote | B01F 5/0413 261/29 |

* cited by examiner

*Primary Examiner* — Elizabeth Insler

(74) *Attorney, Agent, or Firm* — FisherBroyles LLP; Ian R. Walsworth

(57) ABSTRACT

A device for enhanced generation of microbubbles in a more efficient manner is provided. The device is smaller, quieter, and more energy-efficient than prior microbubble-generating devices, and is suitable for use with liquid dispensing devices such as hydrotherapy jets, shower heads, liquid nozzles, and bathtub faucets. Methods of use of the enhanced microbubble system are also disclosed.

20 Claims, 19 Drawing Sheets

ENHANCED MICRO BUBBLE DEVICE, SYSTEM AND METHODS RELATED THERETO

CROSS-REFERENCE TO RELATED APPLICATIONS

This application is a continuation-in-part of U.S. patent application Ser. No. 16/565,314, filed on 9 Sep. 2019, which is a continuation of U.S. patent application Ser. No. 15/146,689, filed on 4 May 2016, which in turn claims the benefit of U.S. Provisional Patent Application 62/156,642, filed 4 May 2015. This application also claims the benefit of U.S. Provisional Patent Application 62/743,197, filed on 9 Oct. 2018. These applications are all incorporated by reference herein in their entireties.

FIELD OF THE INVENTION

This disclosure relates to enhanced micro bubble generation, and in particular to devices and methods for generating microbubbles in water or other fluid. Devices and methods according to this disclosure may also introduce nutrients or sanitizing agents into the water or other fluid. Finally, this disclosure also relates to systems and methods for filtering elements from a source of water or other liquids introduced into a tub or similar compartment.

BACKGROUND

Prior art devices for generating microbubbles have drawbacks which hamper their efficiency and impair their practical uses. One known method for producing microbubbles is to electrolyze a liquid between two electrodes, in which the microbubbles are formed at the surface of one of the electrodes by a gas released in the electrolysis reaction. Such electrolysis processes are too costly to produce microbubbles on a large scale and cannot practically be utilized in conjunction with liquid dispensing fittings because of the physical size and configuration of the necessary components. Furthermore, such systems are typically large and require electrical enclosures to house the necessary components.

U.S. Pat. No. 4,556,523 to Lecoffre et al. ("Lecoffre") discloses a microbubble injector comprising a deflector wall, which radially deflects a flow of water exiting under pressure from an injector hole and saturated with dissolved air, thus producing cavitation at the edges of the injector hole and generating microbubbles of air downstream of the injector hole. Similarly, U.S. Pat. No. 6,293,529 to Chang et al. ("Chang") discloses a bubble generating apparatus including a hollow shell having a plurality of bottom inlets and a side outlet, a screw rod longitudinally mounted in the shell, and a baffle threaded onto one end of the screw rod and suspended inside the shell above the bottom inlets, the baffle having a plurality of smoothly arched bottom notches for baffling intake flows of high-pressure liquid to produce bubbles. The inventions of Lecoffre and Chang suffer from several disadvantages, however, and could not be used practically or efficiently with typical liquid dispensing fittings, such as hydrotherapy jets, shower heads, and liquid nozzles.

U.S. Patent Application Publication No. 2007/0108640 to Takahashi et al. ("Takahashi") discloses a microbubble-generating device which incorporates small orifices or screens through which the pressurized liquid and gas must travel. Such features are undesirable because debris and contaminants present in the liquid may clog the orifices/screens, so that at least one of (1) expensive pre-filtering of the liquid prior to reaching the small orifices/screens and (2) repeated and continual cleaning of the orifices/screens would be required to maintain the device in an operational state. Extensive maintenance of this type would place an unnecessary burden on the end user and thus is not practical. The clogging of the small orifices/screens may also be detrimental to a system employing the microbubble-generating device, because the blockage could cause excessive back pressure, resulting in premature wear on system components.

There is thus a long-felt need for a microbubble-generating device that does not utilize orifices or screens which may become clogged, which can produce large quantities of microbubbles while occupying a small physical space and utilize smaller components that are practical to use with liquid dispensing fittings such as hydrotherapy jets, shower heads, liquid nozzles, and bathtub faucets. It is further advantageous for the device to be capable of operating in conjunction with a plumbing fixture having aesthetic or ornamental appeal, e.g. a bathtub, without detracting from the fixture's aesthetic or ornamental appeal.

Faucets, spigots, pumps, nozzles and other fixtures may include a filter or screen placed between a water source and a tub, basin or similar fluid reservoir. Such filters are often attached in direct communication to the water source in order to provide filtration of contaminants before the water exits the reservoir. Many filter assemblies are complex and require space to mount below a countertop or other structure associated with the reservoir and may further require specific coupling between the filter assembly and the faucet, spigot or fixture as in U.S. Pat. No. 5,983,938, for example.

Other filter assemblies must be attached to the faucet directly below the base of the water faucet. See, for example, U.S. Pat. No. 5,510,031. Such filter assemblies are only replaceable from above the countertop after the water faucet assembly has been removed, making it difficult for a user to replace or substitute filter media. Other filter assemblies occupy countertop space and include filters that are replaceable from above the countertop, but suffer from other disadvantages, including their large footprint, difficulty in replacing filter media, and lack of proximity to the water supply.

There is thus a long-felt need for a filtration assembly that can accommodate a wide variety of fittings, including but not limited to hydrotherapy jets, shower heads, liquid nozzles, bathtub and spa diffusers, and bathtub faucets. It is further advantageous for the assembly to be easy to access and adjust, and if necessary remove and replace the filter media periodically. It would also be beneficial if the assembly is not bulky, requires tooling or reconfiguration of surrounding countertops, flooring, etc., and that otherwise does not detract from the fixture's aesthetic or ornamental appeal.

SUMMARY

The invention provides an enhanced microbubble pump system without orifices or screens that can produce large quantities of microbubbles in a manner that makes the system practical for use with typical liquid dispensing fittings, such as hydrotherapy jets, shower heads, liquid nozzles, and bathtub faucets. A microbubble pump described herein occupies a physical volume 30-40% smaller, is 10-15% quieter in operation, and uses about 35% less electricity than has heretofore been achieved by the solutions of the prior art. The microbubble pump described herein has an improved shaft seal compared to the devices of the prior art, limiting the possibility of water damage to internal components, and retains little or no water. The microbubble pump described herein also produces a superior quantity and quality of microbubbles as compared to prior art solutions and can be produced with materials that are ozone-compatible. Microbubble pump systems, as disclosed herein, require only two interconnections to a bathtub or plumbing, as compared to the four interconnections typical of prior art systems. Significantly, the microbubble pump disclosed herein can be mounted 3-5 inches lower on a bathtub than prior art devices, greatly diminishing the pump's impact on the overall aesthetic appeal of the bathtub.

The present disclosure provides a microbubble system, comprising a gas inlet comprising a first Venturi injector; a pressure vessel, with a microbubble device therein, interconnected to the gas inlet, the pressure vessel configured to receive liquid via a liquid source and mix the liquid with gas received via the gas inlet, the microbubble device configured to generate microbubbles of the gas in the liquid to form a microbubble-entrained liquid; and an outlet interconnected to the pressure vessel, configured to receive the microbubble-entrained liquid from the pressure vessel and dispense the microbubble-entrained liquid.

In example embodiments, the outlet comprises at least one of a microbubble nozzle and a second Venturi injector.

In example embodiments, the microbubble system further comprises a pump interconnected to the pressure vessel and configured to pump the liquid from the liquid source into the pressure vessel. The gas inlet may be located on at least one of an outlet of the pump and an inlet of the pump.

In example embodiments, the gas inlet is located on at least one of an inlet of the pressure vessel and an inlet line feeding the pressure vessel.

In example embodiments, the microbubble system further comprises a third Venturi injector configured to inject a fluid additive either into the liquid before the liquid enters the pressure vessel or into the microbubble-entrained liquid dispensed from the outlet. The fluid additive may comprise at least one of a nutrient and a sanitizing agent.

In example embodiments, the microbubble system is configured to be interconnected to a vessel. The vessel may be selected from the group consisting of a bathtub, a shower, a hot tub, a swimming pool, a plunge pool, a foot bath, a sink, a trough, a wash basin, a washing machine, a dishwasher, an irrigation ditch, a well, and a spray gun.

In example embodiments, the microbubble system further comprises an attachment interconnected to the outlet and configured to receive the microbubble-entrained liquid. The attachment may be selected from the group consisting of a hair brush, an ear/nose/mouth outlet, a faucet outlet, a handheld wand, a basin, a massager, a handheld scrubber, a soaking vessel, a facial cleansing brush, a multi-outlet jet port, a vessel wall-mounting outlet, and a facial outlet device.

The present disclosure also provides a microbubble system, comprising a gas inlet comprising a first Venturi injector; a pressure vessel interconnected to the gas inlet and configured to receive liquid via a liquid source and mix the liquid with gas received via the gas inlet; a microbubble device configured to generate microbubbles of the gas in the liquid to form a microbubble-entrained liquid; and a microbubble nozzle outlet, interconnected to the pressure vessel and configured to receive the microbubble-entrained liquid from the pressure vessel and dispense the microbubble-entrained liquid.

In example embodiments, the microbubble device is housed within the pressure vessel.

In example embodiments, the microbubble system is configured to interconnect to a vessel containing the liquid, wherein the microbubble device is submerged in the liquid within the vessel. The vessel may be selected from the group consisting of a bathtub, a shower, a hot tub, a swimming pool, a plunge pool, a foot bath, a sink, a trough, a wash basin, a washing machine, a dishwasher, an irrigation ditch, a well, and a spray gun In example embodiments, the microbubble system further comprises a second Venturi injector configured to inject a fluid additive either into the liquid before the liquid enters the pressure vessel or into the microbubble-entrained liquid dispensed from the microbubble nozzle outlet. The fluid additive may comprise at least one of a nutrient and a sanitizing agent.

In example embodiments, the microbubble system further comprises an attachment interconnected to the microbubble nozzle outlet and configured to receive the microbubble-entrained liquid, the attachment selected from the group consisting of a hair brush, an ear/nose/mouth outlet, a faucet outlet, a handheld wand, a basin, a massager, a handheld scrubber, a soaking vessel, a facial cleansing brush, a multi-outlet jet port, a vessel wall-mounting outlet, and a facial outlet device.

The present disclosure further provides a method for forming an enhanced microbubble-entrained liquid, comprising receiving a starting liquid and a gas; mixing the starting liquid with the gas; generating microbubbles of the gas in the starting liquid to form a microbubble-entrained liquid; and injecting a fluid additive into at least one of the starting liquid and the microbubble-entrained liquid.

In example embodiments, the fluid additive comprises at least one of a nutrient and a sanitizing agent.

It is another aspect of some embodiments of the present invention to provide a filtration system that may be used with one or more of the embodiments of the present invention described above.

These and other advantages will be apparent from the disclosure contained herein.

As used herein, "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

It is to be noted that the term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

The embodiments and configurations described herein are neither complete nor exhaustive. As will be appreciated, other embodiments of the invention are possible utilizing, alone or in combination, one or more of the features set forth above or described in detail below.

DETAILED DESCRIPTION

Unless defined otherwise, all technical and scientific terms used herein have the same meaning as is commonly understood by one of ordinary skill in the art. All patents, applications, published applications, and other publications to which reference is made herein are incorporated by reference in their entirety. In the event that there is a plurality of definitions for a term herein, the definition provided in the Brief Summary of the Invention prevails unless otherwise stated.

Figure 1:
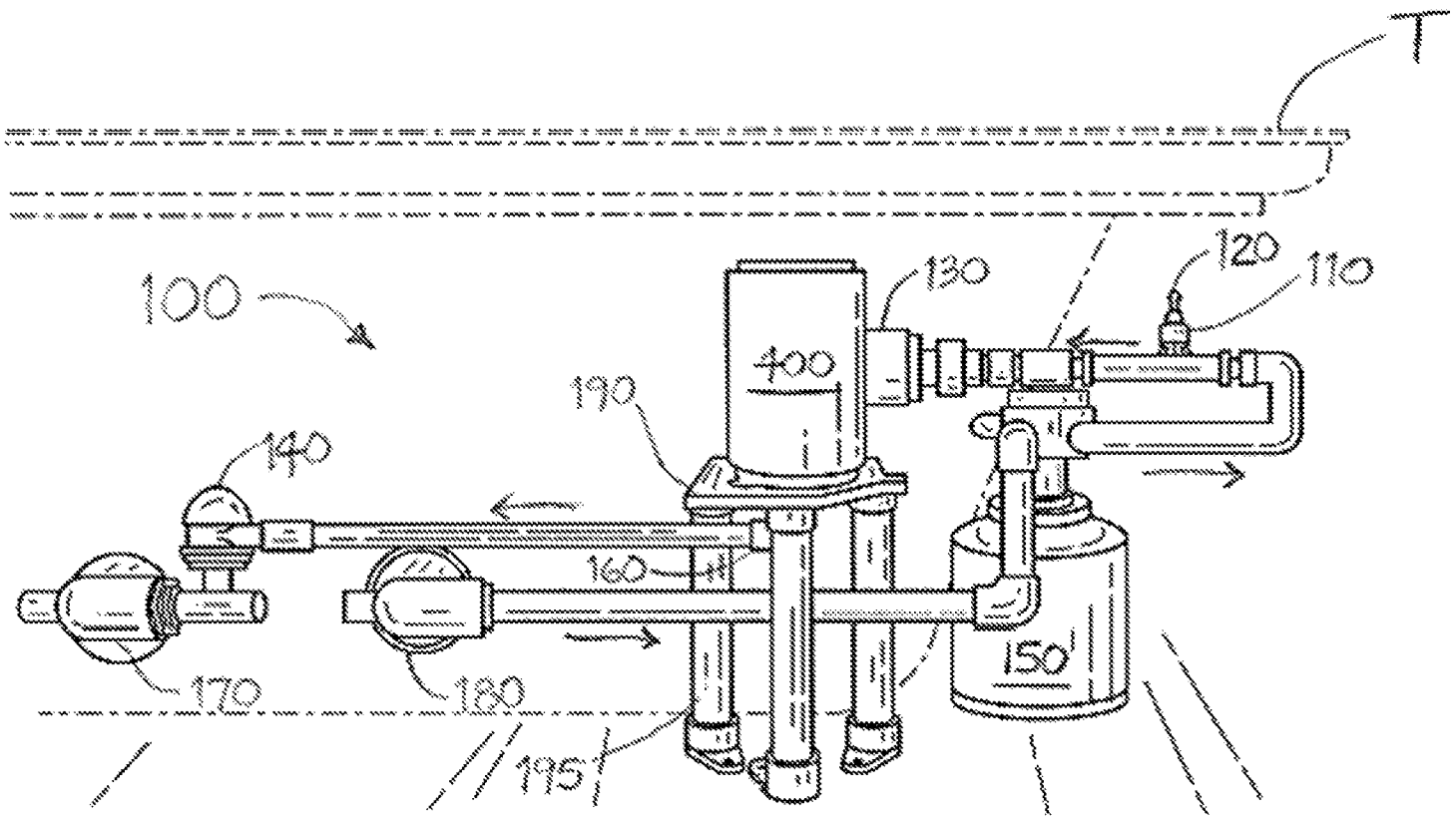
FIG. 1 illustrates components of a microbubble system according to embodiments of the present invention.

Referring now to FIG. 1, a microbubble system 100 according to embodiments of the present invention is illustrated. The system 100 in this embodiment may be interconnected with a basin or bathtub T for circulating fluid therethrough. The system 100 preferably comprises a gas inlet 110, which preferably comprises an injector 120, which may be a jet pressure injector or equivalent injector. The gas inlet 110 is preferably upstream from the pressure vessel 400, such that gas fed into the system from the gas inlet 110 is fed to the microbubble device (not shown in FIG. 1) enclosed within the pressure vessel 400. Once gas and fluid are combined within the pressure vessel 400 as described in detail below, microbubble entrained fluid exits the pressure vessel outlet 160 at the bottom of the pressure vessel 400 and is fed to a stimulating nozzle 140 referred to in FIG. 10A. The stimulating nozzle 140 stimulates the fluid and feeds one or more outlets 170 to the bathtub T. Alternatively the fluid is fed to one or more other outlets or devices, such as those described in relation to FIGS. 11-22. In the embodiment of FIG. 1, the fluid within the tub is recirculated through the system by inlet 180, which is shown attached to the bathtub T. An optional domestic water supply may also be coupled to the system 100 downstream from the inlet 180 or otherwise to supply water or other fluid to the system 100, and in certain embodiments eliminates the need for a pump.

Prior art microbubble systems often comprise a pump. The pump may be a centrifugal pump used for shallow water wells and comprises a liquid inlet, a gas inlet on the liquid inlet, a prime port (on a back side of the pump, not shown), a liquid outlet, and a drain port. Because air or other gas is injected to the pump on an inlet or suction side of the pump, cavitation may take place within the pump itself, creating unnecessary noise and an increased likelihood of shaft seal failure. These prior art pumps are also quite large, not self-priming, and requires four connections to a bathtub or plumbing. Water may be retained within the pump, which may lead to the growth of bacteria or molds. The pump may have a substantial electricity requirement of ten amps, and be mounted in a particular direction given the constraints on the bathtub or other plumbing fixture. These and other limitations of the pumps of the prior art are overcome by the microbubble devices and systems illustrated in FIGS. 1 and 4-7.

As shown in FIG. 1, the system in a preferred embodiment comprises a pump 150 that overcomes the problems with the large, not self-priming centrifugal pumps used in prior art systems for improved circulation of the fluid contained in the system 100. This pump 150 may be substituted for a booster pump when combined with a domestic water supply. The supply of fluid is maintained by the pump 150 and the recirculation of fluid throughout the system 100, and provides a consistent stream of fluid to the pressure vessel 400, in part by the recirculation of fluid described above, and in part with the assistance of the pump 150. Likewise, the gas supply is consistent by use of the gas inlet 110, thereby maintaining the pressure and supply of gas to the pressure vessel 400. Further details regarding the supply and combining of gas and liquid to enhance microbubble production are provided below. The pressure vessel 400 may be secured to a stand 190 comprising a plurality of legs 195 to better assist the benefits of the system and desired recirculation of fluid described above. As shown, the system 100 may be placed much closer to a bathtub T and without requiring a footprint larger than the contours of the bathtub T, thereby permitting the system 100 to be contained within a structure surrounding a basin, or hidden behind a freestanding bathtub T.

Figure 2:
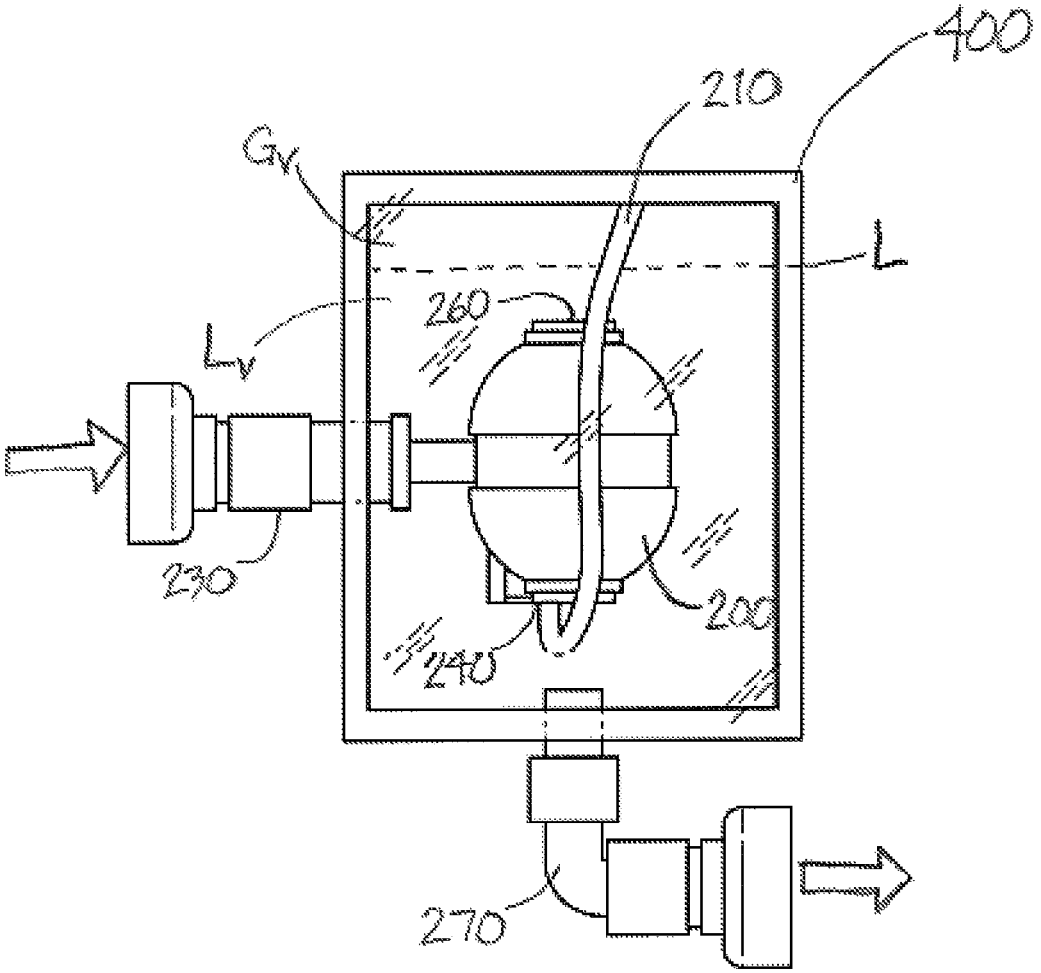
FIG. 2 is a front elevation view of a microbubble device and pressure vessel according to embodiments of the present invention.

Referring now to FIG. 2, a pressure vessel 400 and microbubble device 200 according to embodiments of the present disclosure are shown. In operation, microbubbles of the gas are generated by the microbubble device 200 within the pressure vessel 400. Gas may be introduced into the pressure vessel 400 by supply line 210. This supply line 210 is in communication with a volume of gas Gv which is maintained in the upper portion of the pressure vessel 400. Fluid is supplied to the microbubble device 200 through inlet 230, and once combined with the gas from the supply line 210 may exit the microbubble device 200 through openings 240 preferably located in the bottom of the microbubble device 200. The microbubble-entrained liquid then flows to the microbubble outlet nozzle 270 and/or injector outlet, which dispenses the liquid according to a desired use.

The microbubble device 200 may comprise drainage hole 260 for draining excess fluid. The microbubble device 200 is housed within the pressure vessel 400 such that it remains fully submerged in fluid below the fluid level L, such that the draining occurs into the volume of liquid Lv maintained within the pressure vessel 400. In a preferred embodiment, the volume of liquid Lv is about 90% by volume of the pressure vessel 400 volume, and the volume of gas Gv is about 10% by volume.

In embodiments, one or more Venturi injectors may inject gases or liquid additives to the liquid prior to the liquid entering the pressure vessel 400. Venturi injectors may additionally be used in conjunction with the microbubble outlet nozzle to inject additional gases or liquids into the dispensed liquid. In embodiments that do not comprise a pump, the pressure vessel 400 may be interconnected directly to the liquid source.

In varying embodiments, the system may be used with a traditional or stand-alone bathtub. However, other vessels suitable for use with systems of the present invention include, but are not limited to, showers, hot tubs, swimming and plunge pools, foot baths, sinks, troughs, wash basins, washing machines, dishwashers, irrigation ditches, wells, spray guns, and any other vessels used for bathing, hydrotherapy, cleaning or processing food, and the like.

Figure 3:
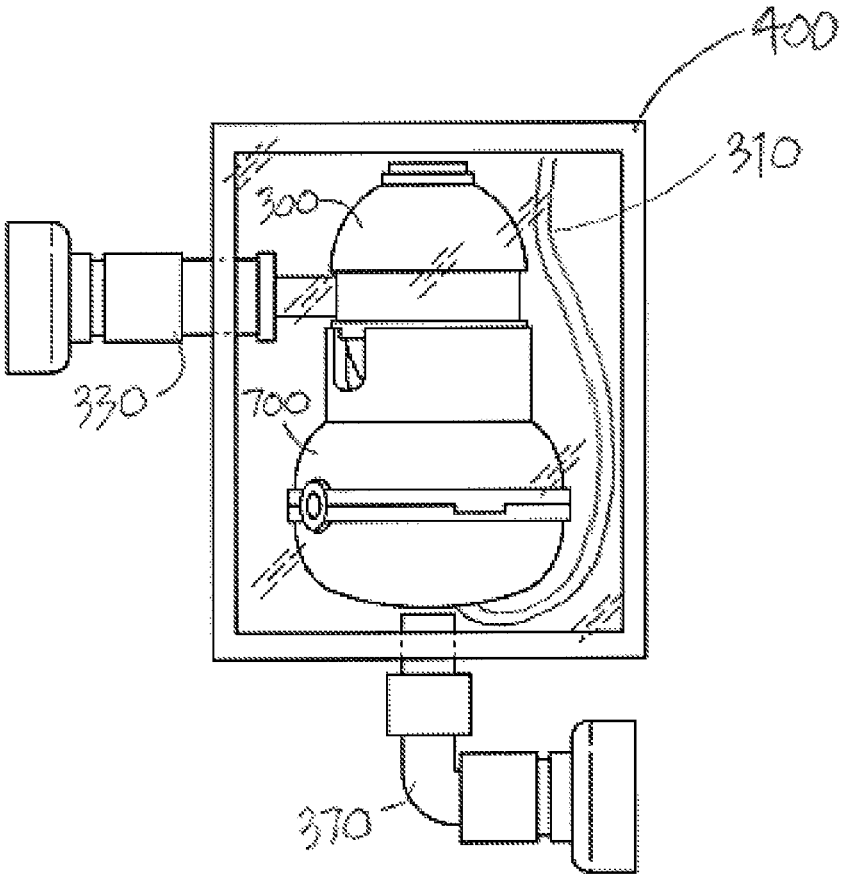
FIG. 3 is a front elevation view of a microbubble device and pressure vessel according to another embodiment of the present invention.

Referring now to FIG. 3, another embodiment of the microbubble device 300 is shown within a pressure vessel 400 similar to the one described above in relation to FIG. 2. Here, the fluid enters the microbubble device 300 through inlet 330, and microbubble entrained liquid may exit the pressure vessel 400 through outlet 370. The gas may be supplied through a supply tube 310. However, this microbubble device 300 further comprises a shroud 700 that facilitates enhanced microbubble production. The shroud 700 facilitates gas transfer into the liquid and promotes liquid thin film technology to create gas exchange, rather than merely gas injection. This occurs due to the shroud 700 diffusing the gas, continuously producing and breaking down the numerous bubbles to create a larger volume of microbubbles within the liquid. The pressure within the pressure vessel 400 causes the microbubbles to rise and pass around the surface of the shroud 700 once the liquid is sufficiently entrained. This in turn improves the gas/fluid boundary, and permits microbubbles produced by the microbubble device 300 to pass through the shroud 700 and into the pressure vessel 400.

As shown in FIGS. 2-3, the microbubble device is preferably housed within a pressure vessel 400, although in certain embodiments may be provided separate from a pressure vessel, such as in a system contained within a basin or other vessel that contains the water or other liquid to be entrained with microbubbles. The microbubble device is a generally egg-shaped device, comprising one inlet of fluid and one inlet of gas, which may be mixed prior to entering the microbubble device. The fluid is entrained with the gas to create microbubbles, and exits the bottom of the microbubble device into the pressure vessel. During this process, the mixture separates such that about 90% of the volume is comprised of fluid, and about 10% is comprised of gas. The 10% of gas (by volume) generally rises to the top of the pressure vessel. The mixture then exits the vessel and passes through a stimulating nozzle for increased micro bubble performance.

Thus, in embodiments described above, the outlet of the microbubble device is in communication with the interior of the pressure vessel, thereby permitting recirculation of microbubbles within the pressure vessel and delivery through one or more attachments or outlets. A separate nozzle may further stimulate the fluid to create an active concentration of microbubbles flowing to the outlet and into the basin or tub. This stimulating nozzle may be positioned before the outlet and after the pressure vessel.

The system thereby provides a steady flow or fluid entrained with microbubbles without significant loss of pressure and avoiding clogging of the outlet or inlet. As the microbubble device inlet receives a mixture of liquid and large gas bubbles, and as the liquid is converted to all gas bubbles from the steady pressure within the microbubble device, the gas may be released from the device into the top of the pressure chamber tank and controlled at a consistent 40 psi with steady flow and no restrictions. This is beneficial compared to the prior art systems, which comprise pumps as described above operating at 60 psi or higher, with fluctuations, and associated restricted flow.

Figure 4:
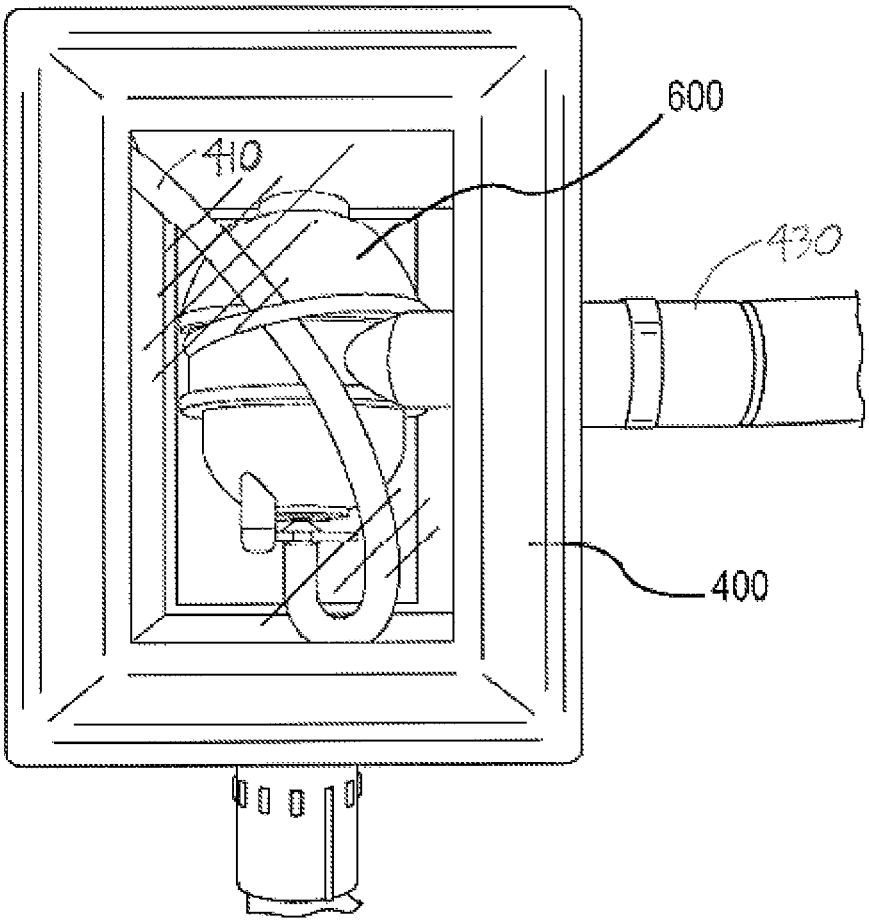
FIG. 4 is an illustration of a pressure vessel with a microbubble device according to embodiments of the present invention.

Referring now to FIG. 4, a pressure vessel 400 with a microbubble device 600 according to another embodiment of the present invention is illustrated. The pressure vessel 400 may have a shape different from that shown in FIG. 4. In addition, the microbubble device 600 may or may not comprise a shroud. The microbubble device 600 in this embodiment is sized to a smaller pressure vessel 400, but still providing a mixture of gas from the supply line 410 and fluid from the inlet 430 to provide operation as described above.

Figure 5:
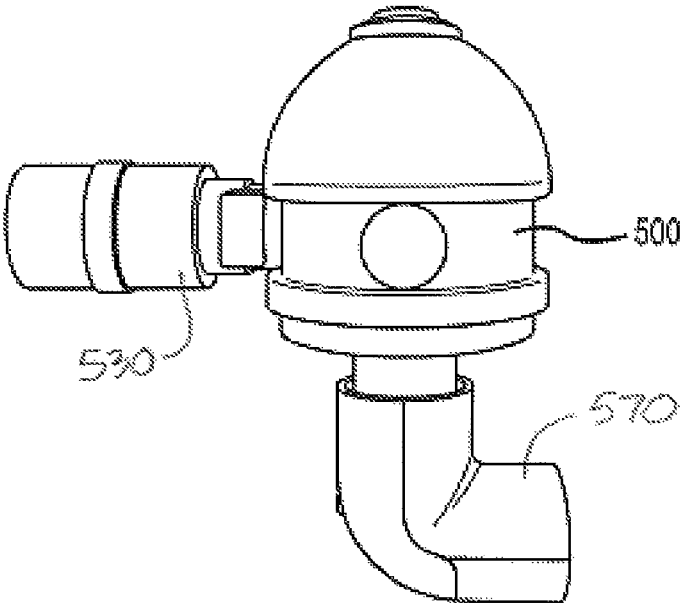
FIG. 5 is an illustration of a nozzle for use with microbubble devices according to embodiments of the present invention.

Referring now to FIG. 5, a stimulating nozzle 500 for use with microbubble devices according to embodiments of the present invention is illustrated. The nozzle 500 is adapted to be installed on a plumbing line and may serve as the microbubble stimulating nozzle 140 illustrated in FIG. 1. The nozzle 500 is used to mechanically stimulate the microbubbles, allowing a microbubble-entrained liquid to contain higher concentrations of oxygen, ozone, and nutrients. One or more Venturi injectors, with or without regulation devices, may be used in conjunction with the nozzle 500 to inject nutrients or sanitizing agents into the microbubble-entrained liquid. The nozzle 500 may receive the microbubble entrained fluid through inlet 530 and passed through the internal chamber within nozzle 500 (see description of FIG. 10A) and ultimately exit the nozzle 500 through outlet 570.

Figure 6:
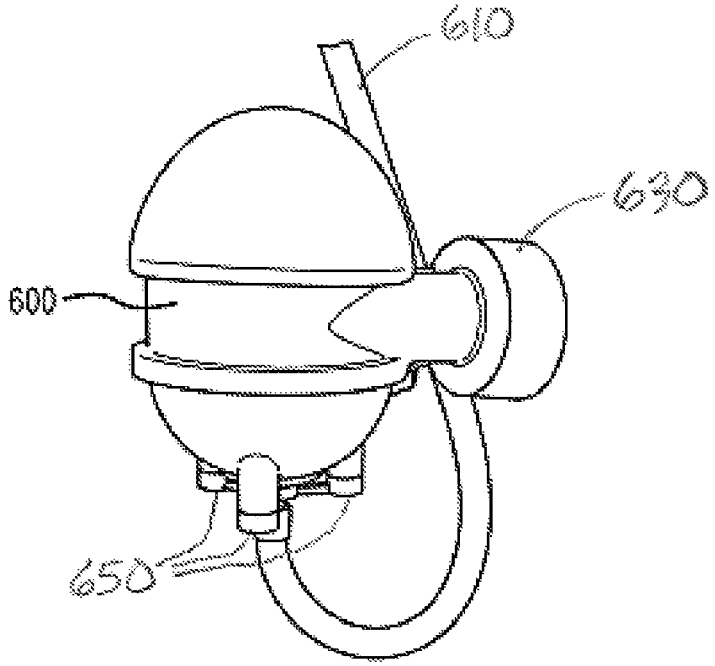
FIG. 6 is an illustration of the microbubble device of FIG. 4 removed from the pressure vessel.

Referring now to FIG. 6, a microbubble device 600 according to embodiments of the present invention is illustrated. In operation, the microbubble device 600 may be interconnected to or housed within a pressure vessel 400, as illustrated in FIG. 4, or may be installed and submerged directly into a vessel of fluid. The microbubble device 600 may comprise openings 650 for releasing microbubble entrained fluid into the pressure vessel (not shown) or other vessel of fluid.

Figure 7:
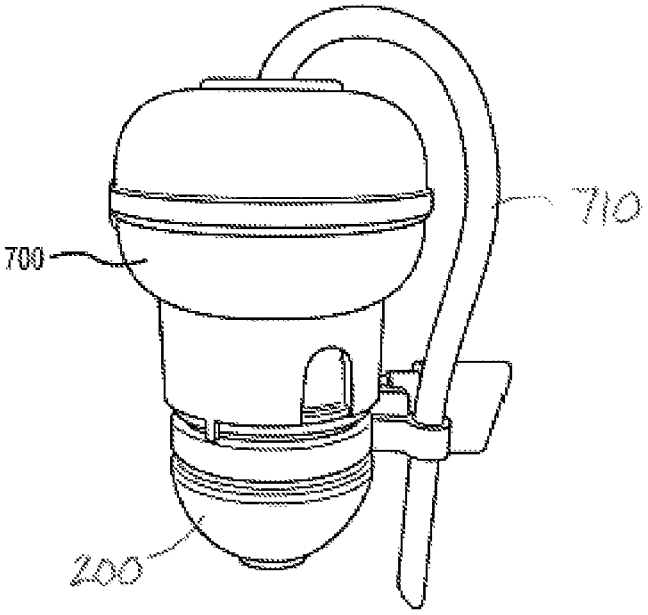
FIG. 7 is an illustration of the microbubble device of FIGS. 4 and 6 with a liquid thin film shroud, according to embodiments of the present invention.

Referring now to FIG. 7, the microbubble device 600 of FIGS. 4 and 6 is provided with a liquid thin film (LTF) shroud 700 as described above in relation to FIG. 3. In addition to the functions and benefits described above, the LTF shroud 700 protects inner functional components and improves the aesthetics of the microbubble device 600. It is to be understood that the microbubble device 600 of FIG. 6 may be provided with or without the LTF shroud 700.

Figure 8:
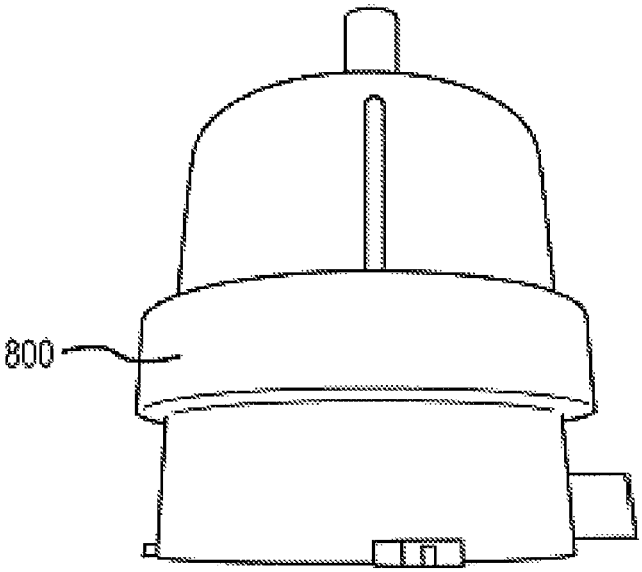
FIG. 8 (PRIOR ART)
FIG. 8 is an illustration of a prior-art pressure vessel.

Referring now to FIG. 8, a pressure vessel 800 as known and described in the prior art, and suitable for use with microbubble devices of the prior art, is illustrated. The pressure vessel 800 of FIG. 8 is much larger than the pressure vessel 400 of the present invention as illustrated in FIG. 4 and described herein.

Figure 9A:
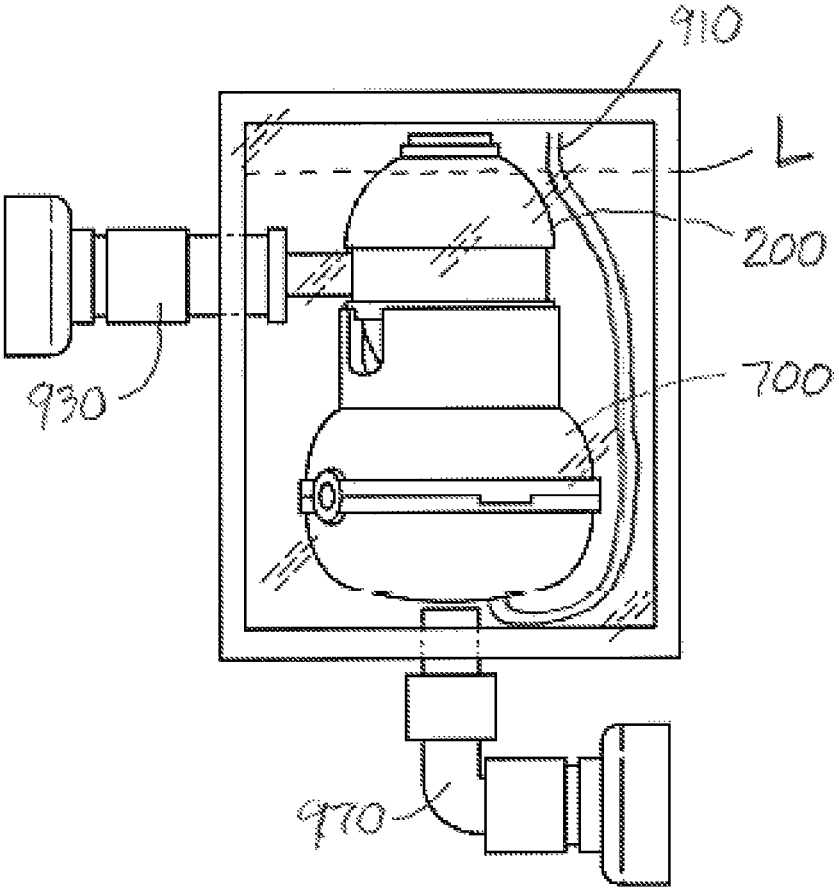
FIG. 9A illustrates a microbubble device and pressure vessel according to another embodiment.
Figure 9B:
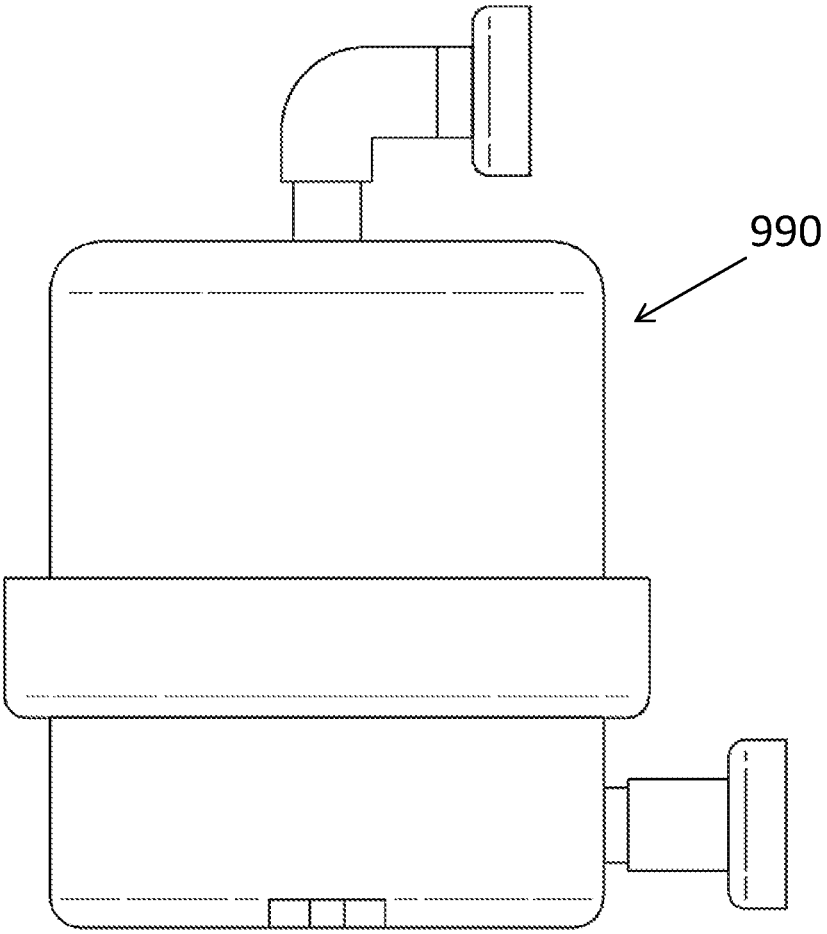
FIG. 9B illustrates a microbubble device and pressure vessel according to yet another embodiment.

Referring now to FIGS. 9A-9B, variations of the microbubble device and pressure vessel are shown. In FIG. 9A, the device comprises a shroud 700 as described above, and is in a generally translucent pressure vessel having a rectangular shape. In FIG. 9B, the pressure vessel 990 is non-translucent, and may be comprised of two portions (a first portion and a second portion), which may be joined together for ease of assembly. The dimensions of the pressure vessel according to preferred embodiments are about 4 by 5.75 (in inches) to about 7 by 8.25 (in inches). The microbubble device is preferably 3.25 by 3.75 (in inches) to about 4 by 5.25 when comprising the shroud (in inches). The microbubble device and pressure vessel are much smaller and able to be positioned in a smaller area than prior art microbubble generating equipment.

Figure 10A:
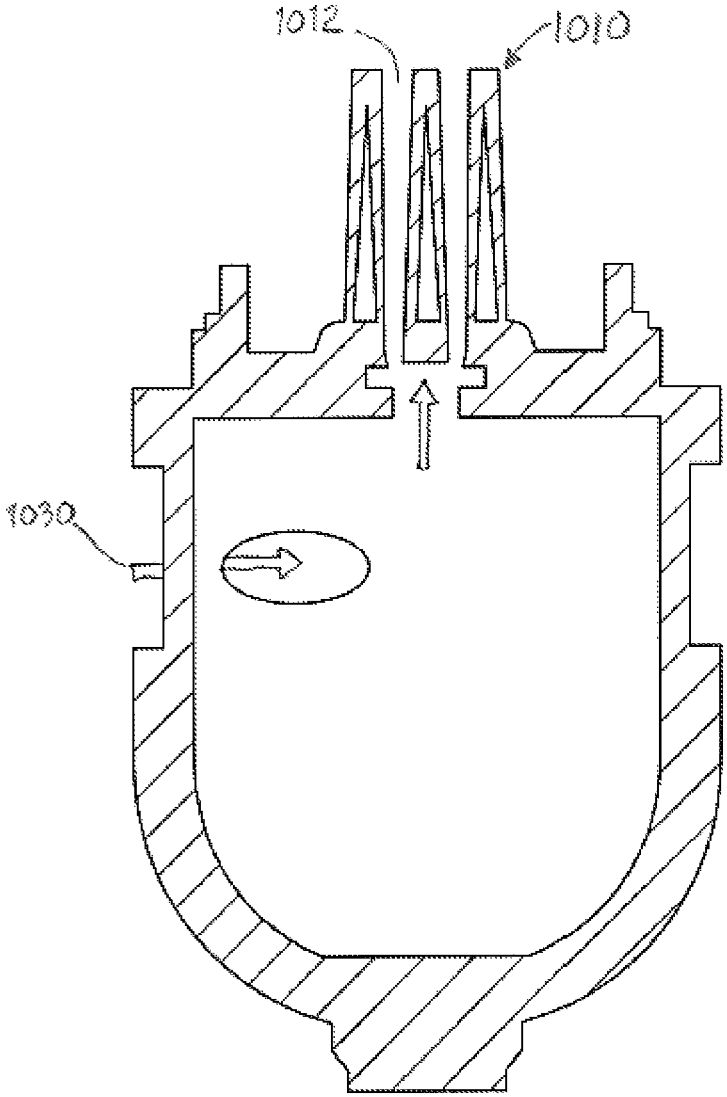
FIG. 10A is a detailed sectional view of the stimulating nozzle of the system according to one embodiment.
Figure 10B:
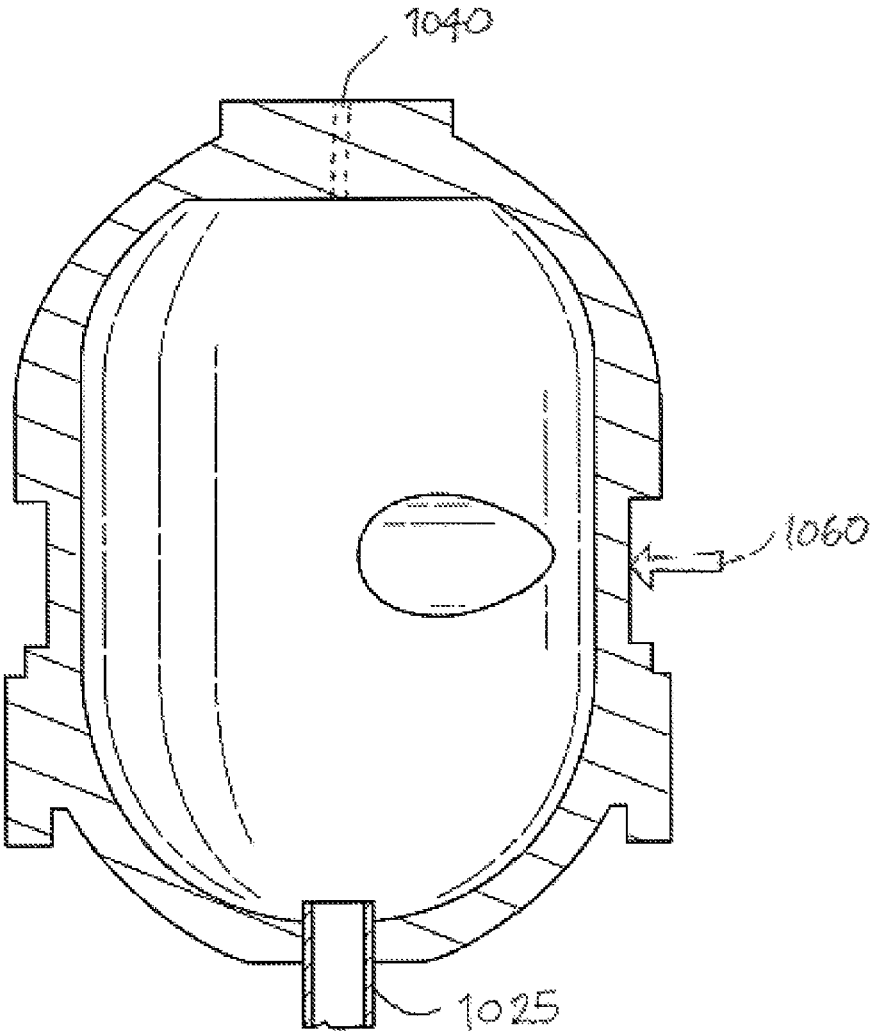
FIG. 10B is detailed sectional view of the microbubble device of the system according to one embodiment.

Referring to FIGS. 10A and 10B, sectional views are shown through the stimulating nozzle and microbubble device, respectively, according to preferred embodiments of the present disclosure. In FIG. 10A, fluid is allowed to enter the stimulating nozzle through aperture 1030 and exit through nozzle outlet 1010. Nozzle outlet 1010 may comprise two or more pathways 1012 for stimulating the water exiting the stimulating nozzle. In FIG. 10B, the microbubble device is preferably egg-shaped and comprising an inlet 1060 for receiving fluid into the internal chamber of the microbubble device. Tubing 1025 may extend from the gaseous volume portion of the pressure vessel and deliver gas to the microbubble device as described above. The device may further comprise a small opening 1040 for draining excess fluid.

The system 100 comprises at least one injector, which receives fluid and tapers down to create an orifice, and further comprises a gas inlet for receiving ambient or compressed gas. The microbubble device then widens and creates a vacuum for gas or liquid to be drawn into the fluid flowing through the microbubble device, which provides consistent water flow and gas flow. These components of the system are all located on the outlet side of the pump to reduce cavitation and potential system failure, as well as address noise and inconsistent gas flow or pressure.

In use, the system is further designed to permit pressurized water from the microbubble device and the pressure vessel to enter an injector inlet, which causes the pressurized water to become constricted toward the injection chamber. This in turn changes the pressurized water into a high-velocity jet stream, which also serves to increase the velocity through the injection chamber and decrease the absolute pressure, creating a vacuum. This process further permits the addition of an additive material, preferably drawn through the suction port and entrained into the water stream, during the delivery of the pressurized fluid. As the jet stream is diffused toward the injector outlet, its velocity is reduced and it is reconverted into lower pressure energy. Further details regarding the method of use of the system is described below.

Figure 11:
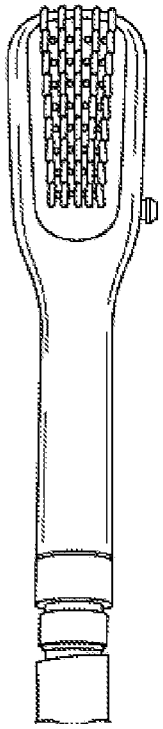
FIG. 11 is an illustration of an attachment to the portable microbubble device according to embodiments of the present invention.

Referring now to FIGS. 11-22, various outlets and attachments that may be suitable for particular applications of the present invention are illustrated. FIG. 11 illustrates a hair brush 1100 comprising multiple ports through which oxygenated or ozonated water may be ejected, as may be suitable, for example, for use in pet grooming or human hair treatment.

Figure 12:
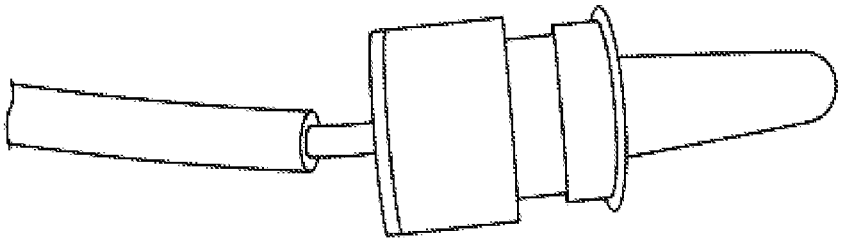
FIG. 12 is an illustration of another attachment to the portable microbubble device according to embodiments of the present invention.

FIG. 12 illustrates an ear/nose/mouth outlet 1200 that may dispense oxygenated or ozonated water, whereby the oxygenated or ozonated water may provide improved cleaning or therapeutic effects due to the tendency of oxygen or ozone bubbles to cling to the surfaces of a user's ear, nose, mouth, etc. for a deeper more thorough cleansing.

Figure 13:
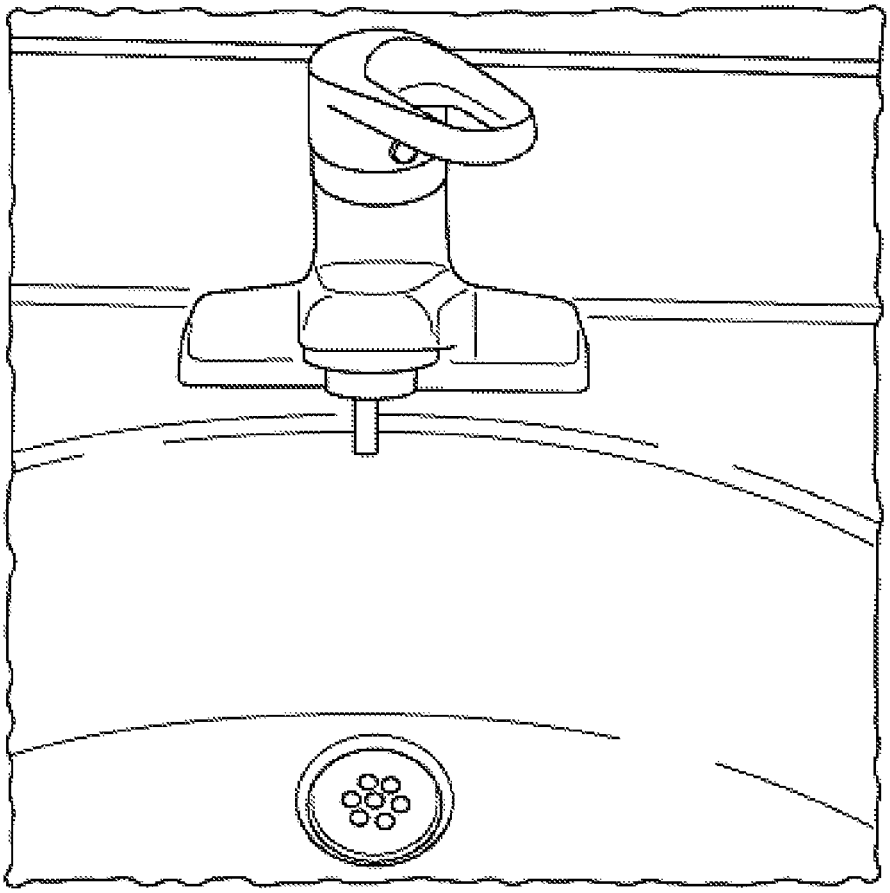
FIG. 13 is an illustration of a faucet outlet to the portable microbubble device according to embodiments of the present invention.

FIG. 13 illustrates a faucet outlet 1300, which may be suitable, for example, for dispensing microbubble-entrained water from a household faucet. It should be noted that the system 100 includes components that could easily be placed underneath a sink or similar sized basin.

Figure 14:
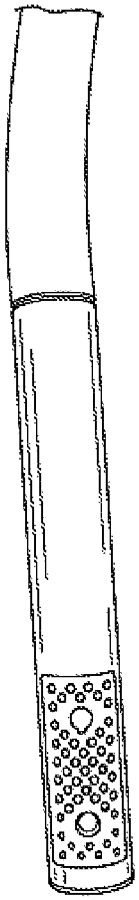
FIG. 14 is an illustration of a wand attachment to the portable microbubble device according to embodiments of the present invention.

FIG. 14 illustrates a handheld wand 1400 comprising multiple ports for ejecting oxygenated or ozonated fluid, and which may further provide microbubble-entrained water as, for example, required for washing or treating the hair or skin of a user.

Figure 15:
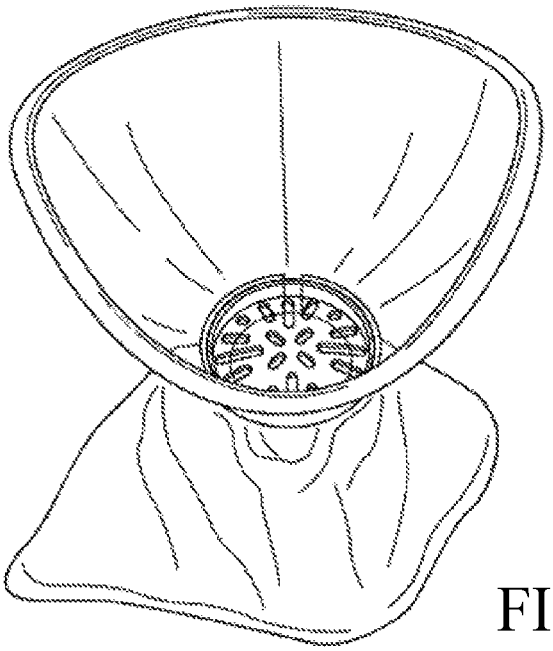
FIG. 15 is an illustration of a basin attachment to the portable microbubble device according to embodiments of the present invention.

FIG. 15 illustrates a basin 1500 suitable for containing and holding oxygenated water during hair or skin treatments and can thus function as, by way of non-limiting example, a hair washing basin, a facial washing basin, a pedicure soak basin, or a shower cap.

Figure 16:
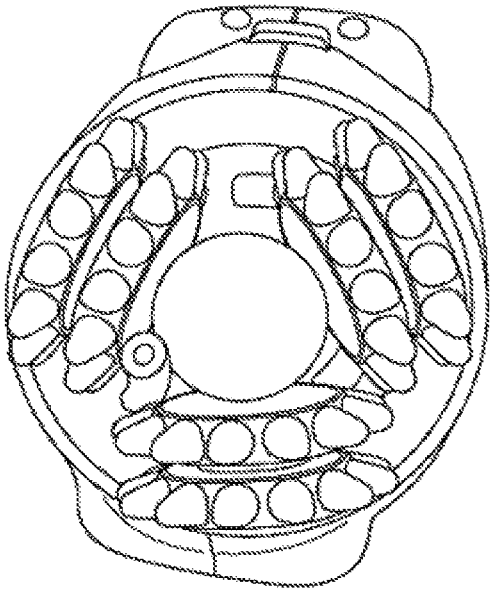
FIG. 16 is an illustration of a massage attachment to the portable microbubble device according to embodiments of the present invention.

FIG. 16 illustrates a trigger point soft tissue muscle massager 1600, which comprises multiple stationary or moveable brushes having outlets for ejecting oxygenated water. These outlets/brushes may either dispense the oxygenated water for therapeutic purposes or utilize the oxygenated water as a motive pressure source for driving mechanical massaging elements.

Figure 17:
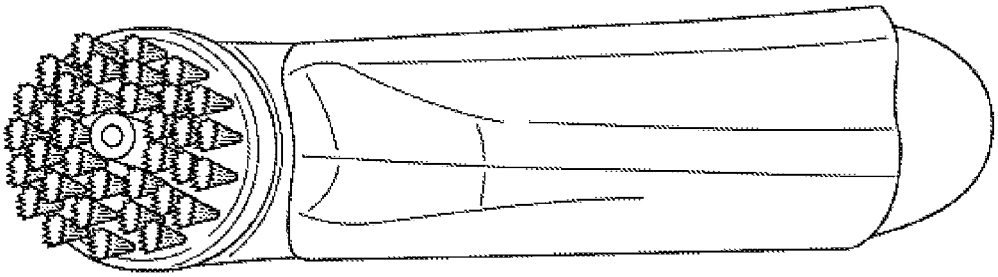
FIG. 17 is an illustration of a scrubber attachment to the portable microbubble device according to embodiments of the present invention.

FIG. 17 illustrates a handheld scrubber 1700 powered by injected oxygenated water, as may be suitable, for example, for mounting to a kitchen sink for cleaning fruits and vegetables, or for cleaning the skin of a user, such as during a pedicure.

Figure 18:
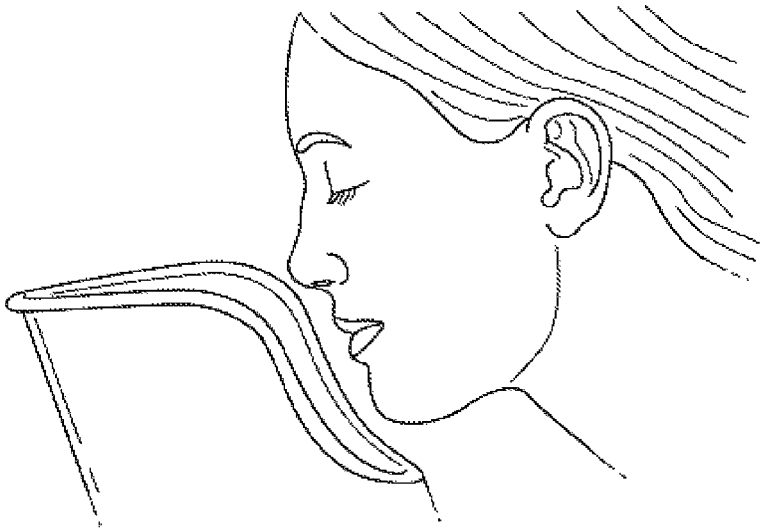
FIG. 18 is an illustration of a soaking vessel attachment to the portable microbubble device according to embodiments of the present invention.

FIG. 18 illustrates a soaking vessel 1800 that may contain oxygen- or sanitizing agent-injected water and may be utilized by a user to, for example, clean, disinfect, or treat skin pores and hair follicles.

Figure 19:
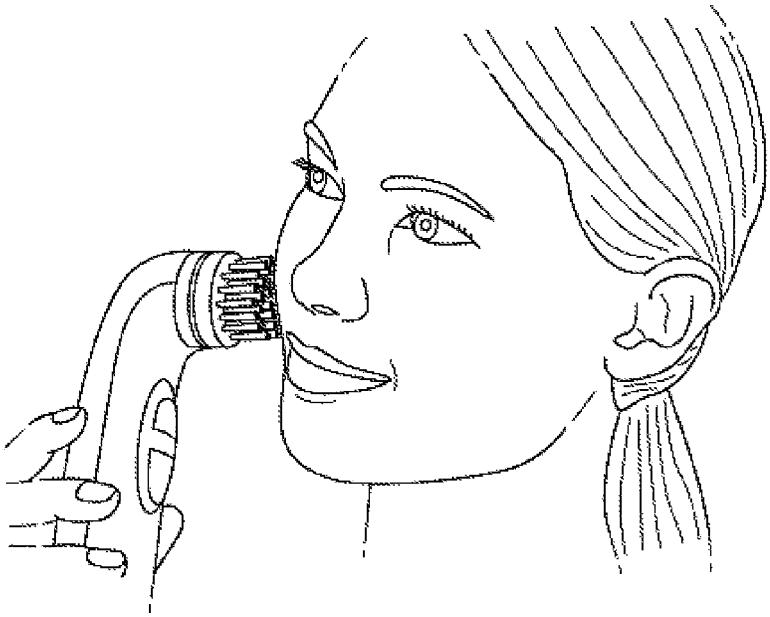
FIG. 19 is an illustration of a brush attachment to the portable microbubble device according to embodiments of the present invention.

FIG. 19 illustrates a facial cleansing brush 1900 that may dispense oxygen- or sanitizing agent-injected water and may be utilized by a user to, for example, clean, disinfect, or treat pores of the skin on the user's face.

Figure 20:
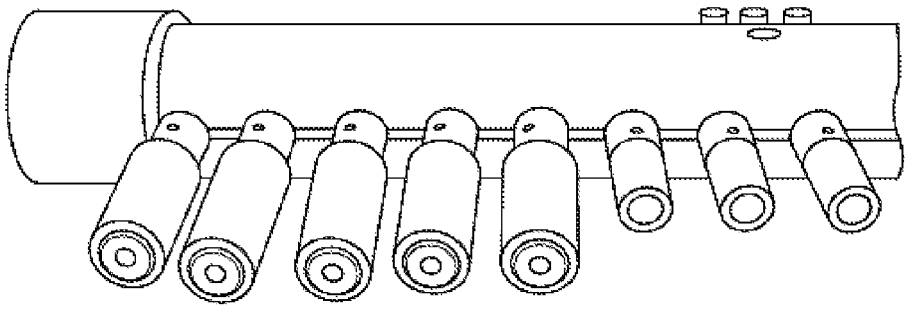
FIG. 20 is an illustration of a multi-outlet attachment to the portable microbubble device according to embodiments of the present invention.

FIG. 20 illustrates a multi-outlet jet port 2000 that may be mounted, for example, on a wall of a vessel or in conjunction with a carpet cleaning device to dispense microbubble-entrained or sanitizing agent-injected water.

Figure 21:
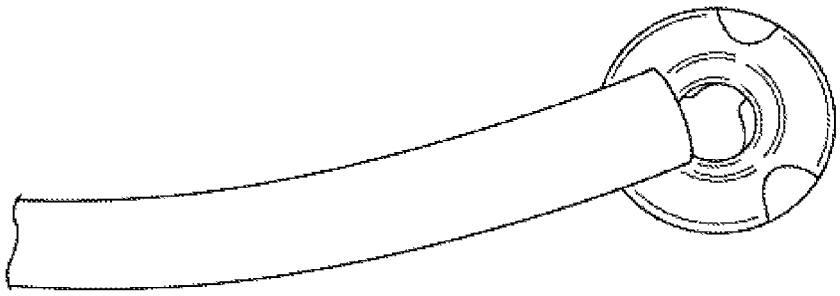
FIG. 21 is an illustration of a single-outlet attachment to the portable microbubble device according to embodiments of the present invention.

FIG. 21 illustrates a standard port outlet 2100 for mounting in the wall of a vessel, the standard port outlet 2100 optionally comprising a hose or other handheld attachments.

Figure 22:
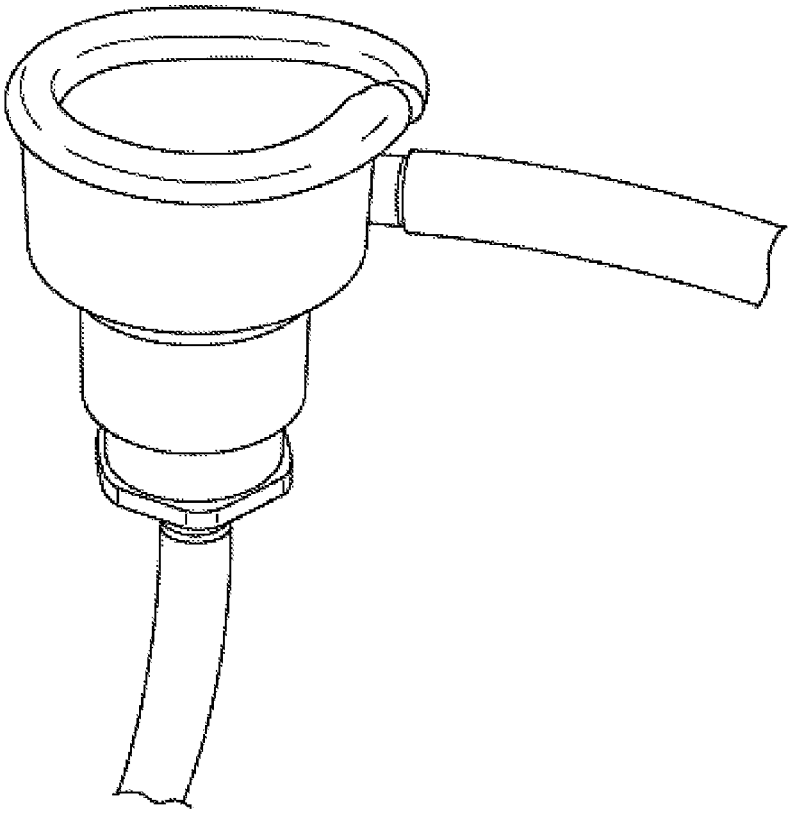
FIG. 22 is an illustration of a facial outlet attachment to the portable microbubble device according to embodiments of the present invention.

FIG. 22 illustrates a facial outlet device 2200, comprising an inlet 2210, a sealing gasket 2220, and an outlet 2230, as may be suitable, for example, for treating target areas such as liver spots on a user's face, scalp, etc. with oxygenated water.

Figure 23:
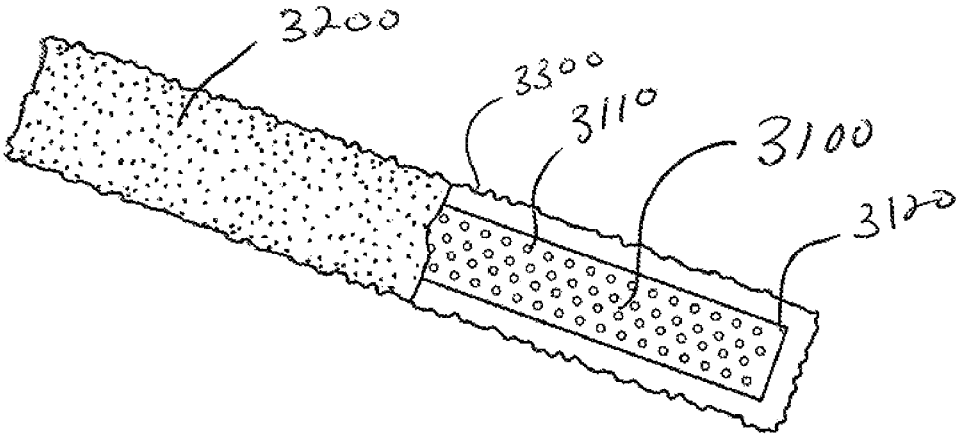
FIG. 23 is a perspective view of a fitting and filter that permits water or other fluid to pass therethrough according to an embodiment of the present disclosure.
Figure 24:
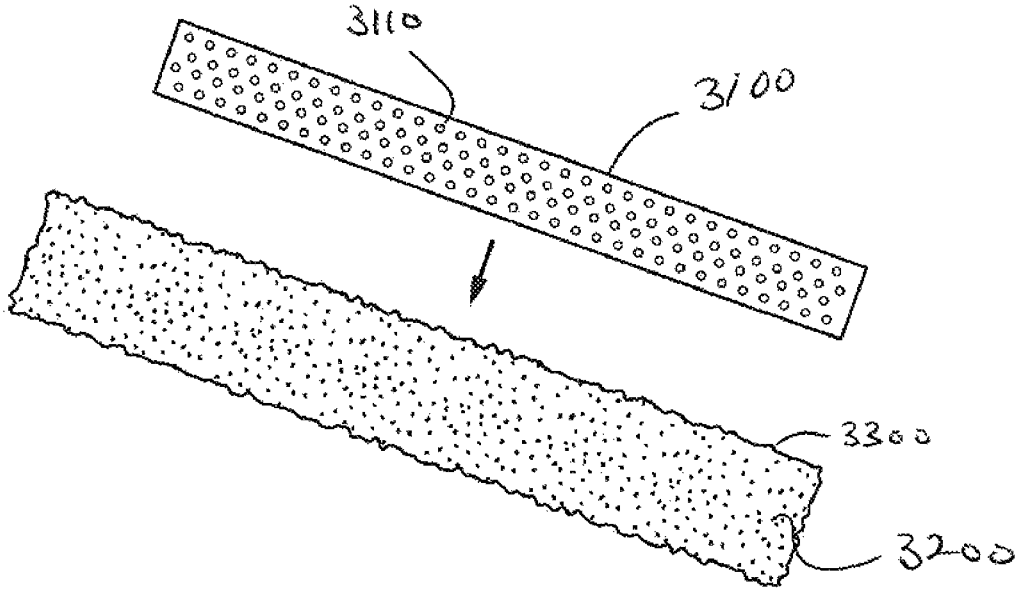
FIG. 24 is a partially exploded view of FIG. 23.

Referring now to FIGS. 23 and 24, a fitting 3100 according to one embodiment of the present disclosure is shown. The fitting 3100 may be attached to an outlet in the side of a tub, basin or other fluid reservoir, for example. The fitting 3100 may comprise a plurality of apertures 3110 for diverting water passing therethrough, which may be arranged in a variety of patterns without departing from the novel aspects of the present disclosure. The fitting 3100 is preferably removable from the tub, basin or fluid reservoir to periodically clean the fitting 3100.

Although not shown in FIG. 24, the fitting 3100 may be associated with an outlet fed by a pump. The pump preferably supplies a water or other fluid to the outlet and then through the fitting 3100. The pump may be a centrifugal pump, preferably of the type used for shallow water reservoirs. The pump may also comprise a liquid outlet and a drain port, but even in such configurations, water may be retained within the pump, which may lead to the growth of bacteria or molds. These molds and bacteria may be introduced into the tub, basin of fluid reservoir as water passes through the pump to the outlet and the fitting.

The fitting 3100 may have a rim or lip 3120, which in one embodiment may be placed substantially flush against a wall of a tub, basin of fluid reservoir. Screws or similar devices may be used to attach fitting to the wall of the fluid reservoir. The fitting 3100 may be circular or shaped in another fashion.

A filter 3200 is preferably sized to be placed adjacent to, and in some embodiments over the fitting 3100, as will be described in greater detail below. The filter 3200 is comprised of a material that permits the flow of water or other fluid to pass therethrough, but also restricts the passage of bacteria, chlorine, toxins, and other microorganisms of a certain particle size. In embodiments, the material is comprised of a cloth material. In other embodiments, the material is comprised of a composite material suitable for filtration of particle sizes specified herein. In one embodiment, the filter 3200 permits filtering of bacteria and other microorganisms larger than about 10 micron. In alternate embodiments, the filter 3200 may be comprised of a denser material to permit filtration of even smaller microorganisms, including those smaller than about 1 micron.

The filter 3200 may be shaped to have an outer perimeter that substantially conforms to the outer circumference of the fitting 3100 and may further comprise an outer edge 3300 that conforms to the lip or rim of the fitting 3100 described above. The outer edge 3300 comprises elastic or similar material to ensure a snug fit against the fitting 3100. In alternate embodiments, the outer edge of the filter 3200 may be placed between the lip or rim of the fitting 3100 and the wall of the fluid reservoir, thereby securing the filter 3200 in place. In either of these embodiments, the filter 3200 is secured to the fitting and, thus. avoids displacement by water passing through the fitting 3100 and the filter 3200.

In one embodiment, the filter 3200 is sized to be placed adjacent to the fitting 3100 on an outer surface (tub-facing side). In other embodiments, the filter may be placed against an inner surface of the fitting 3100. In this configuration, screws or other devices may pass through the filter 3200 and further secure the filter 3200 in place on the inside of fitting 3100. In alternate embodiments, the screws are placed to avoid penetrating the filter 3200.

In operation, the filter 3200 is placed over the fitting and fastened directly or with material along the outer edge 3300 or the filter 3200 so that it fits snugly around the lip or rim of the fitting 3100. The fitting 3100 may be removed from the tub and the filter 3200 replaced from time to time without the use of specialized equipment or difficulty accessing the filter 3200. Different types of filter 3200 may be used with a single fitting, depending on the nature of filtration desired.

The invention illustratively disclosed herein suitably may be practiced in the absence of any element which is not specifically disclosed herein. It is apparent to those skilled in the art, however, that many changes, variations, modifications, other uses, and applications of the invention are possible, and also changes, variations, modifications, other uses, and applications which do not depart from the spirit and scope of the invention are deemed to be covered by the invention.

The foregoing discussion of the invention has been presented for purposes of illustration and description. The foregoing is not intended to limit the invention to the form or forms disclosed herein. In the foregoing Detailed Description of the Invention, for example, various features of the invention are grouped together in one or more embodiments for the purpose of streamlining the disclosure. The features of the embodiments of the invention may be combined in alternate embodiments other than those discussed above. This method of disclosure is not to be interpreted as reflecting an intention that the invention requires more features than are expressly recited. Rather, inventive aspects lie in less than all features of a single foregoing disclosed embodiment.

Moreover, though the description of the invention has included description of one or more embodiments and certain variations and modifications, other variations, combinations, and modifications are within the scope of the invention, e.g. as may be within the skill and knowledge of those in the art, after understanding the present disclosure. It is intended to obtain rights which include alternative embodiments to the extent permitted, including alternate, interchangeable, and/or equivalent structures, functions, ranges, or steps to those described, whether or not such alternate, interchangeable, and/or equivalent structures, functions, ranges, or steps are disclosed herein, and without intending to publicly dedicate any patentable subject matter.

What is claimed is:

1. A microbubble system interconnected with a basin for circulating fluid therethrough, comprising:

a pressure vessel with a top end and a bottom end, the pressure vessel comprising a lower portion containing a fluid and an upper portion containing a gas, and further comprising an outlet at the bottom end of the pressure vessel;

a microbubble device enclosed within the pressure vessel, such that the microbubble device remains fully submerged in fluid, the microbubble device comprising at least one gas supply line and at least one fluid inlet for supplying both gas and fluid to the microbubble device;

a self-priming pump configured to provide a consistent volume of fluid to the pressure vessel;

wherein microbubbles are generated within the pressure vessel by the microbubble device receiving gas from the at least one gas supply line, which maintains a volume of gas in the upper portion of the pressure vessel, and receiving a fluid from the at least one fluid inlet, and combining the fluid and the gas within the microbubble device;

wherein the combined fluid and gas exits the microbubble device through openings located in the bottom of the microbubble device; and wherein the outlet at the bottom end of the pressure vessel is configured to receive the microbubble-entrained liquid from the pressure vessel and dispense the microbubble-entrained liquid.

2. The microbubble system of claim 1, wherein the outlet at the bottom of the pressure vessel comprises at least one of a microbubble nozzle and a Venturi injector.

3. The microbubble system of claim 1, wherein the self-priming pump is a booster pump for circulating a domestic water supply received from a domestic water supply inlet.

4. The microbubble system of claim 1, further comprising a gas inlet, wherein the gas inlet is located on at least one of an outlet of the pump and an inlet of the pump, and wherein the gas inlet comprises an injector.

5. The microbubble system of claim 1, further comprising a gas inlet, wherein the gas inlet is located on at least one of an inlet of the pressure vessel and an inlet line feeding the pressure vessel.

6. The microbubble system of claim 1, further comprising an injector configured to inject a fluid additive either into the liquid before the liquid enters the pressure vessel or into the microbubble-entrained liquid dispensed from the outlet at the bottom of the pressure vessel.

7. The microbubble system of claim 1, wherein the combined gas and fluid exiting the microbubble device is dispensed from the outlet at the bottom of the pressure vessel and then dispensed through a stimulating nozzle, wherein the stimulating nozzle is configured to stimulate the gas and fluid mixture and supply one or more outlets on a wall or a floor of the basin.

8. The microbubble system of claim 7, wherein the basin is selected from the group consisting of a bathtub, a shower, a hot tub, a swimming pool, a plunge pool, a foot bath, a sink, a trough, a wash basin, a washing machine, a dishwasher, an irrigation ditch, a well, and a spray gun reservoir.

9. The microbubble system of claim 1, further comprising an attachment interconnected to the outlet at the bottom of the pressure vessel and configured to receive the microbubble-entrained liquid.

10. The microbubble system of claim 9, wherein the attachment is selected from the group consisting of a hair brush, an ear/nose/mouth outlet, a faucet outlet, a handheld wand, a basin, a massager, a handheld scrubber, a soaking vessel, a facial cleansing brush, a multi-outlet jet port, a vessel wall-mounting outlet, and a facial outlet device.

11. A microbubble system, comprising:

a fluid inlet for supplying at least one liquid to the system;

a gas inlet comprising an injector located upstream from a pressure vessel;

a self-priming pump for circulating liquid to the pressure vessel and throughout the system;

the pressure vessel comprising an internal volume and configured to receive the at least one liquid from the fluid inlet with gas received from the gas inlet;

a microbubble device contained within the pressure vessel and configured to generate microbubbles from the gas and the liquid received within the pressure vessel to form a microbubble-entrained liquid;

a microbubble nozzle outlet, interconnected to the pressure vessel and configured to receive and dispense the microbubble-entrained liquid into the pressure vessel;

wherein the pressure vessel is configured to maintain a volume of gas in an upper portion of the pressure vessel, and a volume of fluid in a lower portion of the pressure vessel; and wherein the microbubble device is configured to generate microbubbles by entraining gas received from the volume of gas in an upper portion of the pressure vessel with the volume of fluid in a lower portion of the pressure vessel.

12. The microbubble system of claim 11, wherein the microbubble device is sealed within the pressure vessel and positioned such that the microbubble device is completely submerged in the volume of fluid in a lower portion of the pressure vessel.

13. The microbubble system of claim 11, configured to interconnect to a vessel selected from the group consisting of a bathtub, a shower, a hot tub, a swimming pool, a plunge pool, a foot bath, a sink, a trough, a wash basin, a washing machine, a dishwasher, an irrigation ditch, and a well.

14. The microbubble system of claim 11, further comprising a second injector configured to inject a fluid additive into the pressure vessel or into the microbubble-entrained liquid dispensed from the microbubble nozzle outlet.

15. The microbubble system of claim 14, wherein the fluid additive comprises at least one of a nutrient and a sanitizing agent.

16. The system of claim 1, wherein the microbubble device further comprises a shroud that enhances microbubble production and gas transfer into the liquid by continuously breaking down bubbles produced within the pressure vessel and creating a larger volume of microbubbles within the liquid, and wherein the pressure vessel maintains the volume of gas at a positive pressure causing excess microbubbles to rise and pass over the shroud until the liquid within the microbubble device is sufficiently entrained with gas.

17. The system of claim 1, wherein the microbubble device is partially hollow and consists of one inlet for supplying fluid and one inlet for supplying gas to the hollow portion of the microbubble device, wherein the fluid and the gas are mixed together and the fluid is entrained with the gas to create microbubbles, and wherein the gas entrained liquid exits an outlet at the bottom of the microbubble device and into the pressure vessel.

18. The system of claim 11, wherein the liquid is dispensed in a basin, and then recirculated through the system by an inlet attached to a wall or the floor of the basin.

19. The system of claim 18 further comprising a domestic water supply inlet for supplying a domestic water supply to the system, and wherein the system further comprises a booster pump for providing the domestic water supply.

20. The system of claim 11, wherein the internal volume of the pressure vessel comprises about 90% liquid by volume and about 10% of gas by volume.

* * * * *